US008235257B2

(12) United States Patent
Avairis

(10) Patent No.: US 8,235,257 B2
(45) Date of Patent: Aug. 7, 2012

(54) EMPTYING MECHANISM FOR FOOD STORAGE CONTAINER

(76) Inventor: Deevin Stanley Avairis, Victoria (CA)

( * ) Notice: Subject to any disclaimer, the term of this patent is extended or adjusted under 35 U.S.C. 154(b) by 924 days.

(21) Appl. No.: 12/324,294

(22) Filed: Nov. 26, 2008

(65) Prior Publication Data

US 2009/0294484 A1 Dec. 3, 2009

Related U.S. Application Data

(60) Provisional application No. 60/990,605, filed on Nov. 27, 2007.

(51) Int. Cl.
*B67D 7/60* (2010.01)
*B65D 88/54* (2006.01)
*B43K 5/06* (2006.01)

(52) U.S. Cl. ..... 222/390; 222/391; 222/386; 222/342; 401/175; 401/171

(58) Field of Classification Search ..... 222/390, 222/391, 386, 386.5, 326, 327, 325, 405, 222/342; 401/68, 75, 175, 88, 116, 82, 174, 401/172, 171
See application file for complete search history.

(56) References Cited

U.S. PATENT DOCUMENTS

| | | | | | |
|---|---|---|---|---|---|
| 835,606 | A | * | 11/1906 | Frimand | 222/390 |
| 1,950,324 | A | * | 3/1934 | Powers | 401/194 |
| 2,284,218 | A | * | 5/1942 | Livingston | 222/49 |
| 2,816,309 | A | * | 12/1957 | Goldsmith | 401/175 |
| 3,612,705 | A | * | 10/1971 | Duval | 401/75 |
| 4,046,288 | A | | 9/1977 | Bergman | |
| 4,521,127 | A | * | 6/1985 | Tomburo et al. | 401/68 |
| 4,544,083 | A | | 10/1985 | Schroeder | |
| 4,545,696 | A | * | 10/1985 | Carluccio | 401/175 |
| 5,733,058 | A | * | 3/1998 | Hofmann | 401/70 |
| 6,269,982 | B1 | * | 8/2001 | Kreiseder et al. | 222/390 |
| 6,592,278 | B1 | * | 7/2003 | Holthaus | 401/66 |
| 6,932,530 | B1 | | 8/2005 | Bissel | |

* cited by examiner

*Primary Examiner* — Kevin P Shaver
*Assistant Examiner* — Stephanie E Williams
(74) *Attorney, Agent, or Firm* — Gordon Thomson

(57) ABSTRACT

A food storage container with emptying mechanism is described. The emptying mechanism includes a platform that may be raised within the container to advance food product toward the container opening. The platform is raised by actuation of a turn wheel at the bottom outer surface of the container. Existing containers may be retrofitted to incorporate the emptying mechanism.

11 Claims, 7 Drawing Sheets

EMPTYING MECHANISM FOR FOOD STORAGE CONTAINER

The present application claims the benefit of priority from U.S. 60/990,605 filed Nov. 26, 2007.

FIELD OF THE INVENTION

The present invention relates generally to storage containers for viscous foods. More particularly, the present invention relates to a mechanism for use in emptying viscous foods from a food storage container.

BACKGROUND OF THE INVENTION

Viscous food products such as peanut butter, margarine, mayonnaise, jams and jellies, etc. are typically packaged in jars or tubs. The consumer is therefore required to place a utensil inside the jar or tub to remove appropriate amounts of food product as needed. As the jar or tub is emptied with continued use, removal of further food product becomes more difficult and increasingly messy, as the handle of the utensil and in some cases the hand of the user must enter the confined space of the jar or tub to scrape remaining product from the jar sides and bottom.

While many food dispensing containers and devices have been devised to simplify the use and application of viscous food products, these containers generally do not empty completely, resulting in wastage of a certain amount of food product. Further, these containers generally hold only small amounts of food product (see for example U.S. Pat. No. 6,932,530 to Bissel; U.S. Pat. No. 4,046,288 to Bergman), often requiring the user to remove the food product from its original bulk container or packaging and place small amounts of food product in the smaller dispensing container. Thus, the problem of removal and emptying the original bulk container is not avoided.

As a specific example, U.S. Pat. No. 4,544,083 to Schroeder describes a butter dispenser. Butter in solid form is removed from its original packaging and essentially skewered within the dispenser upon a threaded rod. An elevator platform about the threaded rod is raised by rotation of a lower knob to dispense butter from the top of the dispenser. The cross sectional area of the container does not vary from top to bottom and is similar to that of a standard stick of butter. The elevator simply pushes the entire solid, formed block of butter upwards towards the top opening where it may be scraped with a knife or applied directly to a food item. In this example, the solid stick of butter provides minimal resistance to advancement towards the opening, and the lower knob is therefore easily turned by the user to advance the solid butter within the dispenser.

It is therefore desirable to provide a bulk storage container and emptying mechanism for viscous food products to avoid the mess and food wastage common with current food containers and dispensers.

SUMMARY OF THE INVENTION

It is an object of the present invention to obviate or mitigate at least one disadvantage of existing bulk containers for viscous food products.

In a first aspect, the present invention provides a container for storing viscous food product, the container comprising:

side walls defining a container interior and an open mouth through which container contents may be accessed, the mouth configured to receive a corresponding container lid;

a support base for placement within the container interior, the support base comprising a central platform and outer scraping edge, the support base of suitable size and shape to sealingly engage the container side walls;

a container base operatively attached to the side walls beneath the support base; and means to advance the support base toward the container mouth so as to scrape container contents from the container side walls, thereby advancing said contents toward the container mouth.

In an embodiment, the container base is rotatably attached to the side walls, and rotation of the container base by the user drives rotation of a threaded rod within the container. The central platform of the support base includes a threaded aperture for engaging the threaded rod to effect travel of the support base within the container in response to rotation of the container base. In a further embodiment, the threaded rod extends upward from the container base to a height that is less than 75% of the distance to the open top.

In a suitable embodiment, the container volume is at least one liter.

In another embodiment, the means to raise the support base provides sufficient upward pressure to raise 50% to 100% of the container contents toward the open top, when the container is used to store viscous food product.

In a further embodiment, the container and emptying mechanism are of suitable size and strength so as to be fillable with at least 500 grams of viscous food product.

In another suitable embodiment, the scraping edge comprises an outwardly biased scraping lip for scraping viscous food product from the interior surface of the container side walls as the support base is advanced. The scraping lip is preferably angled upward toward the open top of the container, and may be tapered to direct scraped food product away from the container sides. In certain embodiments, the distance between interior opposing container side wall surfaces is variable along the height of the container (eg. decreases with container height so as to narrow the container towards the open top), and the outer scraping edge may be formed of resilient material to accommodate such variation as the support base is raised.

In a second aspect of the invention, an emptying mechanism is provided for integration within a viscous product storage container, the emptying mechanism comprising: a support base for placement within a container interior prior to filling of the container with viscous food product, the support base comprising a central platform and outer scraping edge, the support base of suitable size and shape to sealingly engage the container side walls; and means to raise the support base within the container interior as the container is emptied so as to scrape container contents from the container side walls and raise the container contents toward the open top.

In a third aspect of the invention, there is provided a method for retrofitting a food storage container to incorporate an emptying mechanism, the method comprising the steps of:

placing a support base within the empty food storage container, the support base comprising a central platform and outer scraping edge of suitable size and shape to sealingly engage the container side walls;

attaching to the container user-actuated means for raising the support base within the container interior when the container is filled with viscous food product, enabling the user to raise said food product toward the open top.

In an embodiment, the user-actuated means for raising the support base comprises a rotatable turn wheel operatively attached to the container side walls, with rotation of the turn wheel by the user driving rotation of a threaded rod within the container. In this embodiment, the central platform of the support base includes a threaded aperture for engaging the threaded rod to effect travel of the support base within the container in response to rotation of the turn wheel.

Other aspects and features of the present invention will become apparent to those of ordinary skill in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a method and device/mechanism for emptying viscous food from a storage container. Specifically, the invention provides a means for advancing viscous food within the storage container towards the container opening to make remaining food product more accessible to the user as the container is emptied.

Figure 1B:
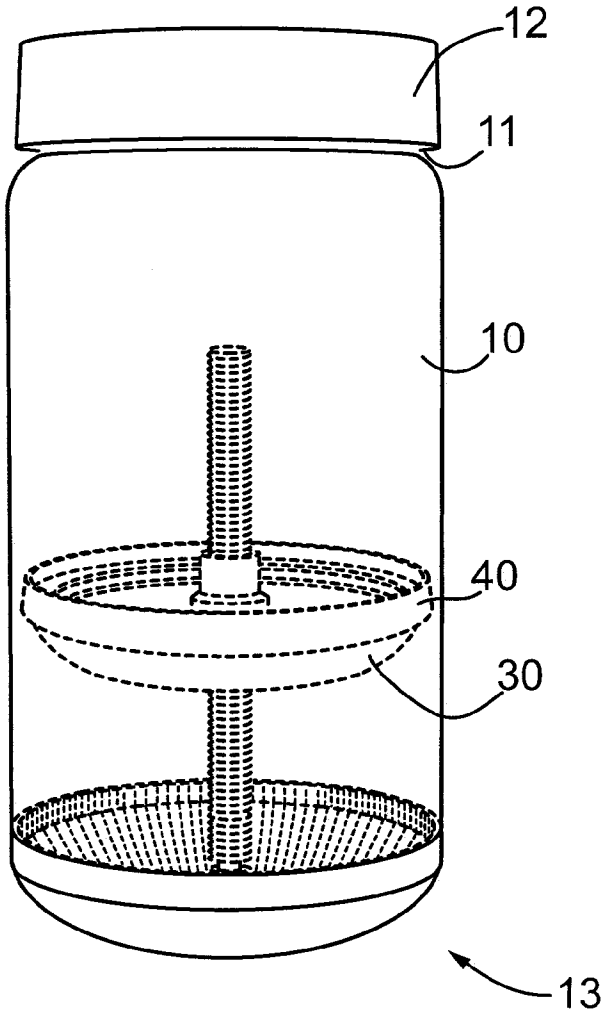
FIG. 1*b* is a perspective view of a storage container with installed emptying mechanism, in one embodiment.
Figure 1A:
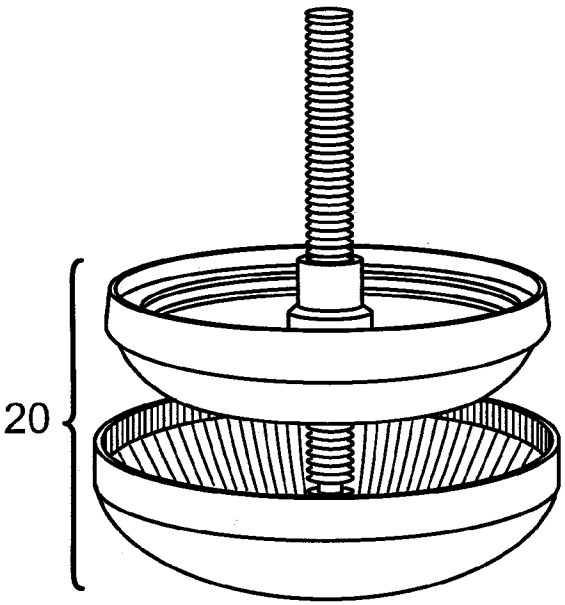
FIG. 1*a* is a perspective view of an emptying mechanism, in one embodiment.

With reference to FIG. 1*a*, a typical prior art plastic storage container 10, with open top 11, lid 12, and bottom 13, (e.g. the type commonly used for peanut butter storage), may be modified to receive an emptying mechanism 20. Once assembled as shown in FIG. 1*b*, the platform 30 may be advanced and retracted within the container as desired. The platform is in lowermost position (FIG. 1*b*) when the storage container is filled. As will be easily understood, when the storage container is full, a user may easily remove food product from the container using a common utensil such as a knife, spoon, or spatula.

Over time, typically once the user has removed approximately half of the contents of the storage container, further removal of food product becomes frustrating and messy, as the handle of the utensil and often the fingers of the user must be placed inside the container. As desired, the user may choose to raise the platform 30 to advance food product remaining in the container towards the top opening 11. The platform 30 bears a scraping edge 40, that applies an outward pressure to the container sides as the platform is advanced to scrape and collect food product from the container sides.

Platform

Figure 2A:
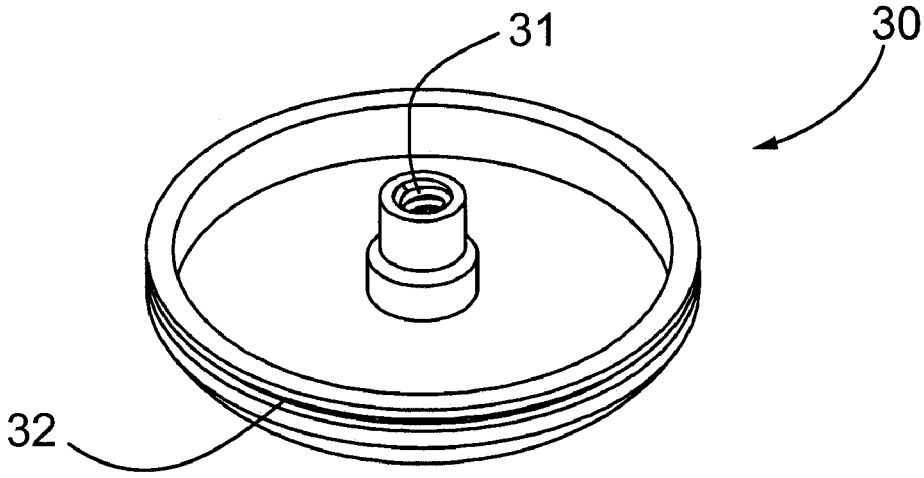
FIG. 2*a* is a perspective view of a support base for use in a food storage container emptying mechanism, in one embodiment.
Figure 2B:
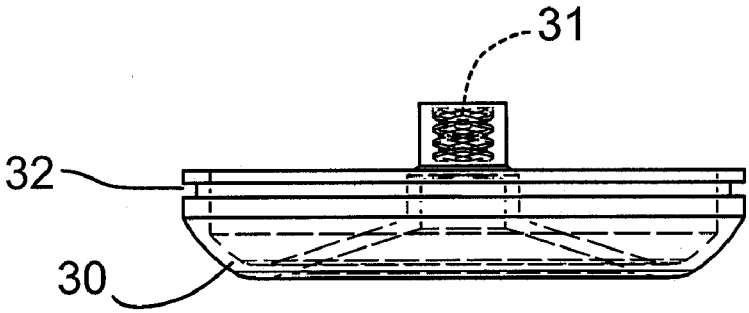
FIG. 2*b* is a side cross-sectional view of a support base for use in a food container emptying mechanism, in one embodiment.

With reference to FIGS. 2*a* and 2*b*, the platform 30 is contoured to fit against the bottom of the storage container when in lowermost position, and the upper surface of the platform is dish-shaped for collection of scraped food product. A central aperture 31 is threaded to receive a threaded rod 50. Thus, the platform may generally be advanced along the threaded rod by rotation of the rod while the platform is held against the container sides. The threaded rod 50 is anchored to a turn wheel 55 at the bottom of the storage container as described below.

The platform 30 includes a scraping edge 40. In the embodiment shown in the Figures, specifically with reference to FIG. 2*b*, the scraping edge 40 is provided as a resilient food grade gasket, for example formed of silicone or nitrile. Accordingly, the platform 30 includes a ledge 32 for supporting the resilient scraping gasket 40.

The platform is formed of a food-grade material of suitable strength to support an appropriate mass of viscous food product. Specifically, the platform should be able to stably support a volume of food product equal to the container volume above the platform when the platform is in any position. For example, when the platform has been raised to half the height of the container, the platform should be sufficiently sturdy to be raised against the remaining half of the container contents. Similarly, the remaining components of the emptying mechanism should support this degree of stability.

In addition, it is preferable to reduce the bulk of the platform and related components as much as possible to minimize loss of food storage volume within the container. Therefore, there must be a balance between providing suitable stability for a particular application (ie. type of food to be stored), while maximizing food storage volume within the container.

The platform and scraping edge may be provided by a one-piece design formed from suitable material such that the platform support and scraping edge functions are both achieved in the one-piece design. The platform may also be collapsible or flexible to ease insertion into the container and assembly through the container mouth, while maintaining suitable structural rigidity in the opposing direction to raise and scrape food product once assembled.

Scraping Edge

The scraping edge 40 of the platform 30 may be integral with the platform 30 or may be provided as a separate component for attachment to the platform during container assembly. The scraping edge should have a diameter across the container that is equal to or slightly larger than the container so as to apply an outward pressure against the container sides as the platform is raised. As certain storage containers may vary in diameter from top to bottom, for example narrowing towards the top opening, the scraping edge should be appropriately sized to provide sufficient outward pressure against the container sides at both the narrowest and the widest portion of the container to be scraped.

Figure 3:
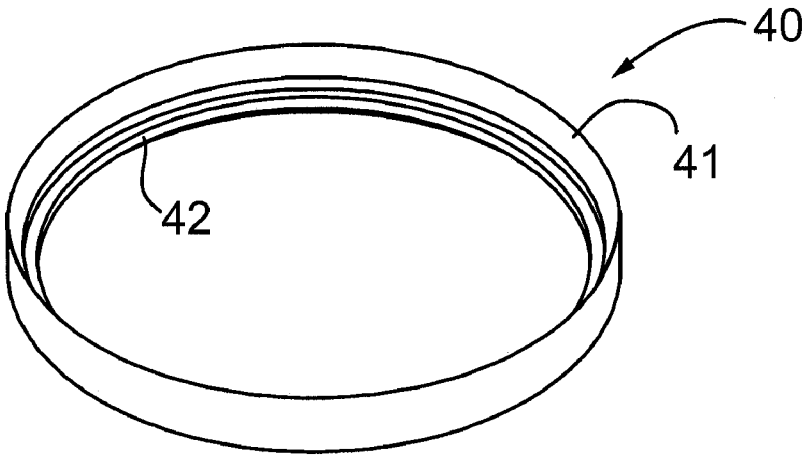
FIG. 3 is a perspective view of a scraping member in one embodiment.
Figure 4B:
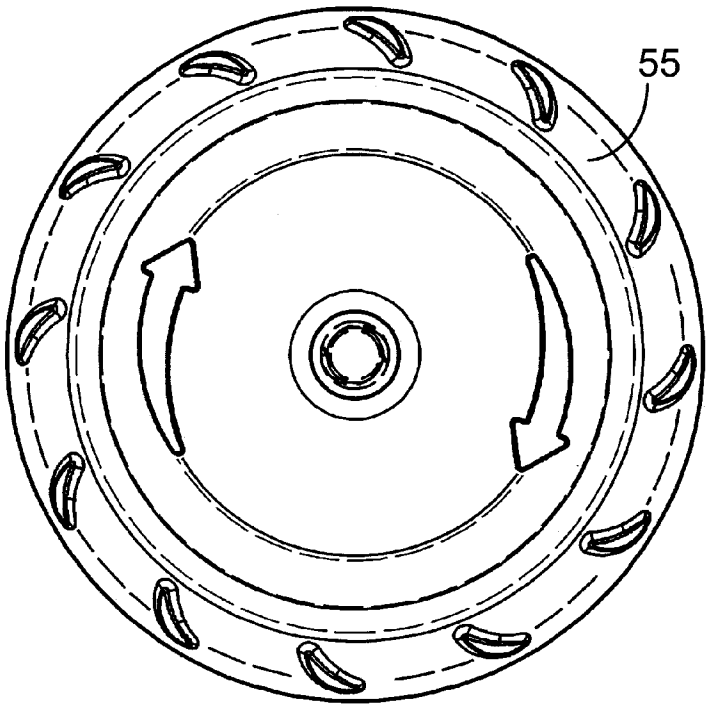
FIGS. 4*a* and 4*b* show perspective and bottom views, respectively, of a threaded rod and attached turn wheel, in one embodiment.
Figure 4A:
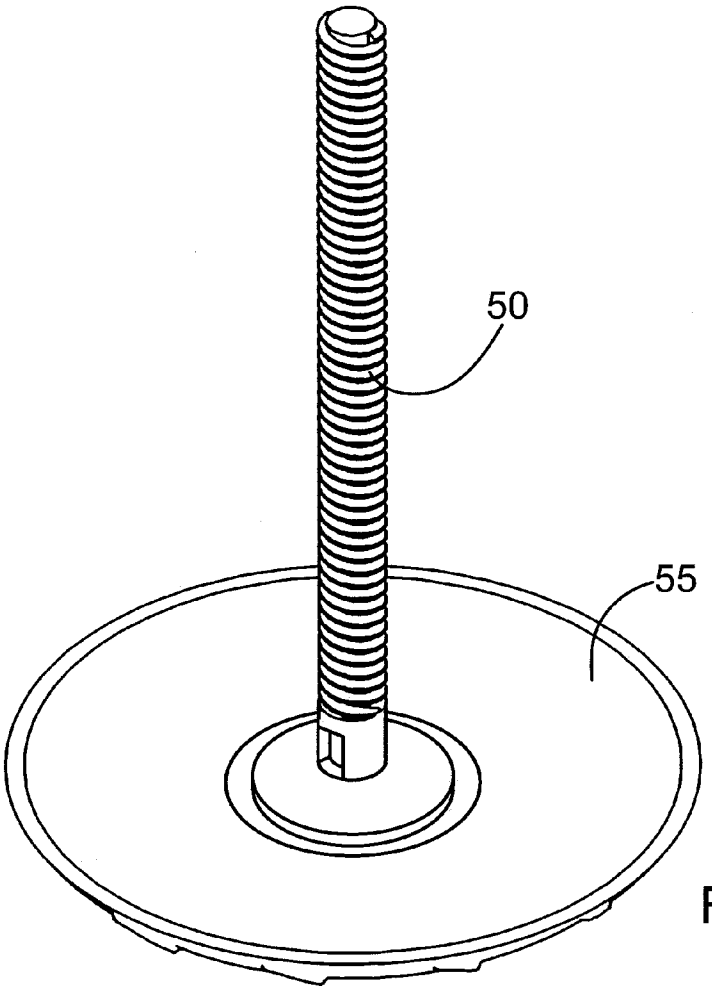

The scraping edge 40 is preferably angled upward as shown in FIG. 3. Further, the scraping edge 40 should include a tapered lip 41 to direct scraped food away from the container sides collecting on the platform 30.

When the scraping edge is provided as a resilient food-grade gasket, as shown in the Figures, the gasket should be of suitable strength to prevent inversion when the platform is advanced against at least half, and preferably the entire container contents. The gasket should similarly be of suitable strength to provide sufficient scraping pressure to remove the particular viscous food product of interest from the container sides. For example, a gasket for use in a 1.5 L peanut butter container would require greater resiliency to avoid inversion and provide sufficient scraping than a gasket for use in a 1.5 L mayonnaise container, due to the differing densities and viscosities of the two food products.

A gasket for use as a scraping edge may be attached to the platform by any suitable food-grade means. For example, as shown in FIG. 3, the gasket includes an attachment ring portion 42 for fitting against a corresponding ledge 32 in the platform 30. The gasket may be stretched over the platform to engage the ledge, and may be further affixed with a suitable adhesive or fastening system.

Alternatively, the gasket may be fixed within a channel or groove of the platform, or simply secured to the platform with adhesive. The means of providing the scraping edge may differ between applications depending on the food product to be stored and the desired or required durability of the emptying mechanism.

Threaded Rod and Turn Wheel

The threaded rod 50 and threaded aperture 31 of the platform 30 bear corresponding threads to impart mechanical motion, for example 5 acme thread (5 threads/inch of length). The threads are preferably bidirectional so the platform may be raised and lowered as desired by the user. Alternatively, for health safety reasons, the thread may provide only for raising the platform so as not to allow cross contamination between the compartments above and below the platform.

The threaded rod 50 may be provided independently of the turn wheel 55, which forms the bottom outer surface of the container, and attached thereto during assembly. Alternatively, and as shown in the Figures, the threaded rod 50 may be integral with the turn wheel 55. The wheel is preferably ribbed to allow proper gripping and actuating of the turn wheel.

The threaded rod may vary in height depending on the food product and size of the container. For example, it may be desirable that the threaded rod extends only halfway up the height of the container so as not to interfere with access to food product in the top half of the container. In other instances, the threaded rod may extend to 90% of the height of the container, allowing the user to dispense product through the open top by actuation of the turn wheel.

In use, once a significant portion of the threaded rod 50 has been exposed (for example when 75% of the container contents have been used), the user may actuate the turn wheel to raise the platform and facilitate removal of further food product. Alternatively, the user may wish to advance the platform with each use, maintaining maximum access to the food product.

The turn wheel and threaded rod should be formed of durable material suitable to withstand rotational forces applied by the user. In addition, as the turn wheel forms the outer bottom surface of the container, it must withstand typical shelf wear. Further, the turn wheel is particularly suitable to containers having a diameter that approximates a user's hand span as this size of turn wheel provides greater mechanical advantage than a smaller turn wheel, while being easy to manipulate by the user.

It is desirable that the components of the emptying mechanism that are to be placed inside the storage container should be as small as possible to maximize the storage space within the container. However, care should be taken to provide sufficiently sturdiness to the components as noted above to ensure proper operation of the device.

In an alternate design, the components of the emptying mechanism may be inserted into the container from beneath the side walls. For example, the turn wheel may form the container base, whereupon insertion of the emptying mechanism provides a means for attachment of the turn wheel to the side walls. Thus, the turn wheel, once the emptying mechanism has been inserted, will be rotatable with respect to the side walls to advance the platform along the threaded rod. As certain applications may not require a sterile environment beneath the platform, a container bottom may not be provided in all embodiments, and the attachment of the turn wheel to the side walls may instead serve as the only container bottom in such embodiments.

Assembly

Figure 5:
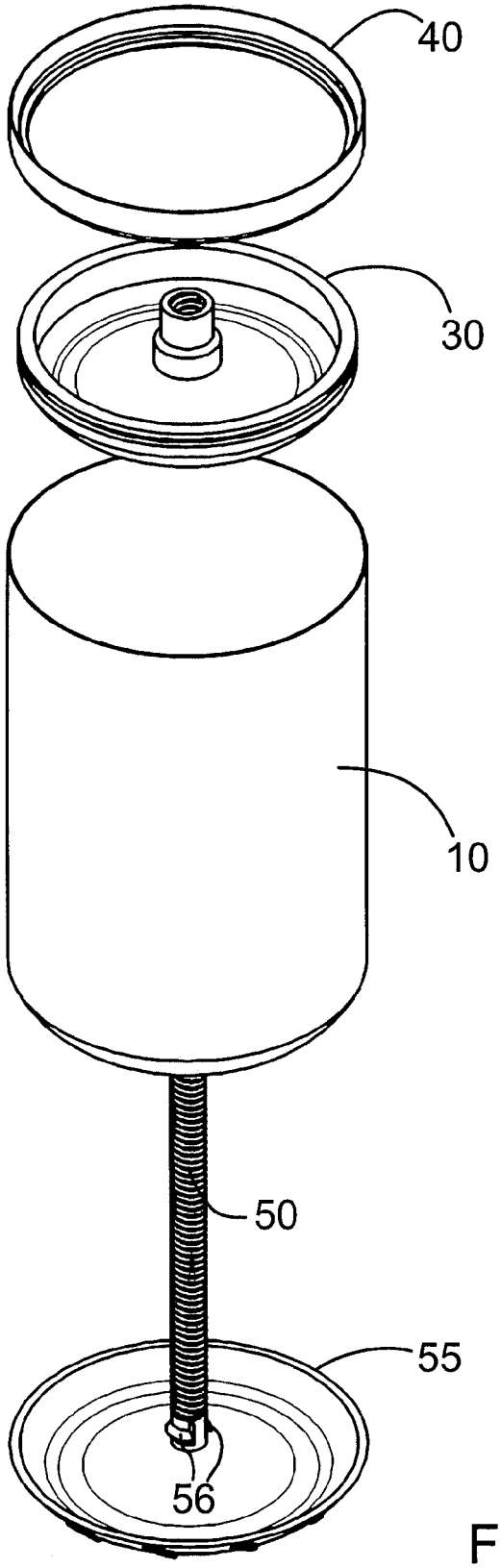
FIG. 5 is an assembly view of a food storage container in one embodiment.

A method of assembly is now described with reference to FIG. 5. A storage container 10 is modified to create a perforation in the container bottom to permit passage of the threaded rod 50. The threaded rod is inserted therethrough until the anchor clips 56 in the bottom of the threaded rod engage the inner surface of the base of the container. Thus, the turn wheel is held by the anchor clips 56 at the base of the container. The platform 30 is then inserted into the container through the top opening 11 and is threaded onto the rod 50 until the platform reaches the bottom of the container. The container is filled with food product, the mouth is sealed with appropriate material (such as foil), and the lid 12 is placed over the mouth. The bottom of the container should also be temporarily sealed for hygienic purposes and to avoid actuation of the turn wheel prior to delivery to the consumer.

As some food products may require the maintenance of more sterile conditions, isolation of the airspace below the platform from the food storage area above the platform may be desirable. Such isolation may be achieved by placement of custom gaskets, O-rings, or other sealing devices at appropriate locations within the container. For example, O-rings may be placed within the threaded aperture 31 of the platform 30. This may also prevent leakage of food product from above the platform 30 along the threaded rod 50.

Figure 6:
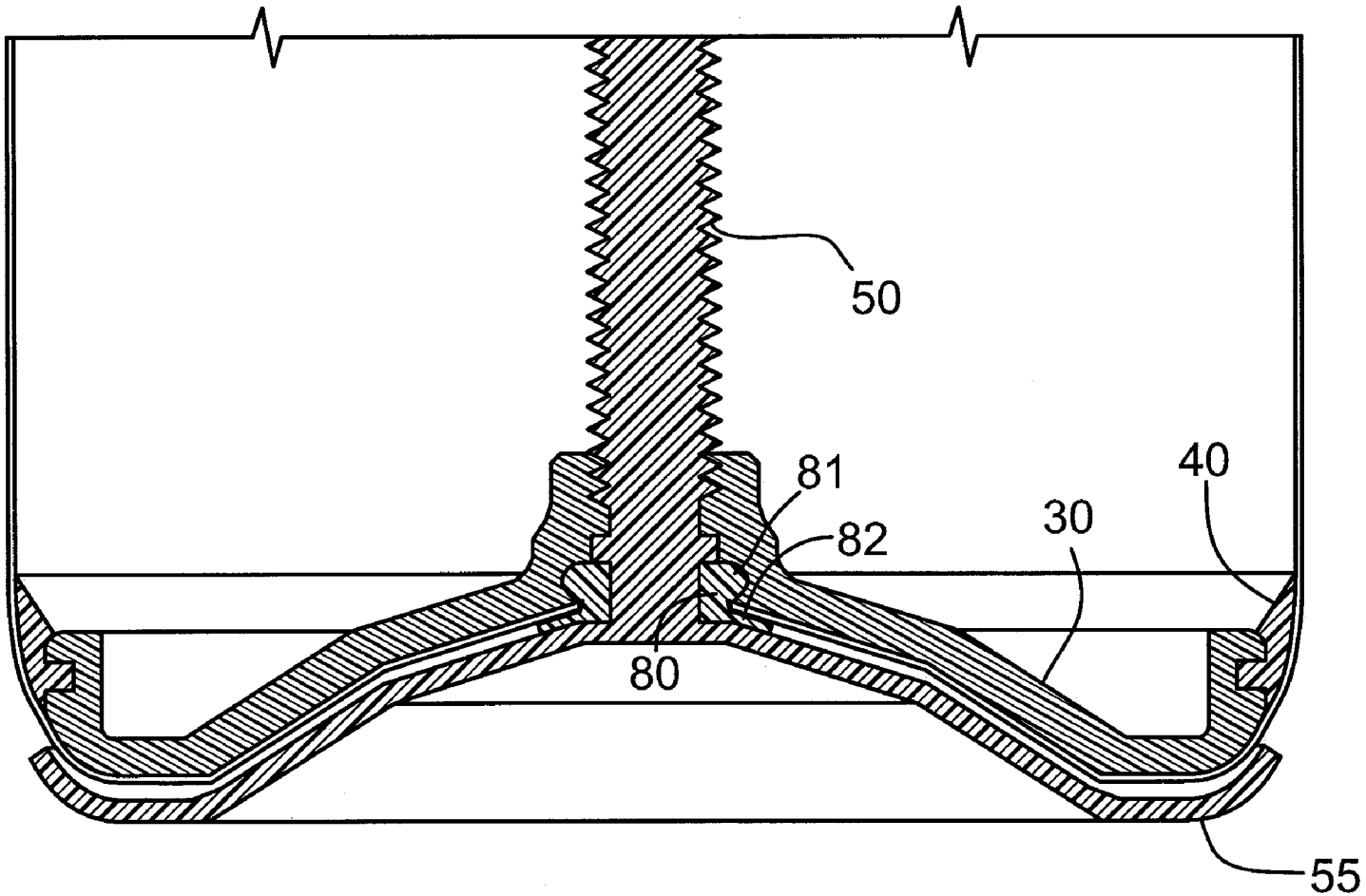
FIG. 6 is a vertical cross sectional view of a container base in one embodiment.

Alternatively, the container may instead be designed to prevent any outside air entry into the area beneath the platform. With reference to FIG. 6, a custom gasket 80 seals the space between the perforated base of the container and the turn wheel/threaded shaft. The gasket 80 bears a shoulder portion 81 for insertion within the container through the perforation, and a flange portion 82 to engage the underside of the container base. In this embodiment, the gasket is placed within the perforation at the base of the container, and the threaded rod 50 is placed within the container, inserted through the gasket, and secured to the turn wheel. The gasket allows free rotation of the turn wheel and threaded rod to advance the scraping platform, while preventing entry of debris, air, and microbes into the airspace below the platform as it is advanced.

Figure 7A:
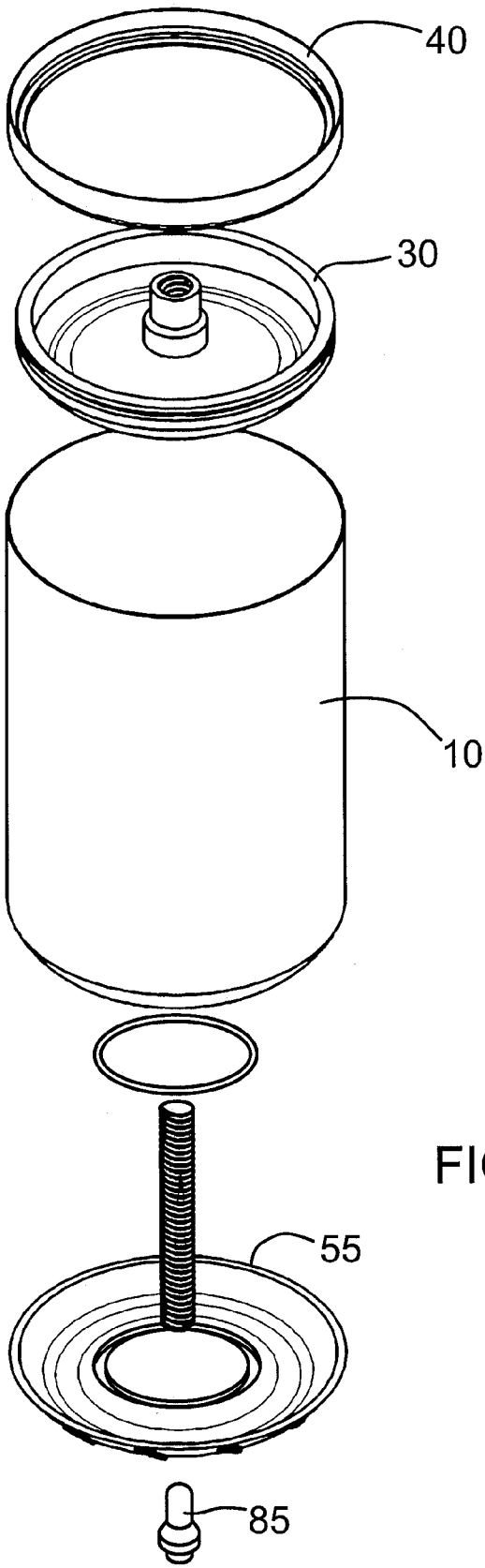
FIG. 7*a* is an assembly view of a food storage container in one embodiment; and, FIG. 7*b* is a vertical cross sectional view of the base of the container depicted in FIG. 7*a*.
Figure 7B:
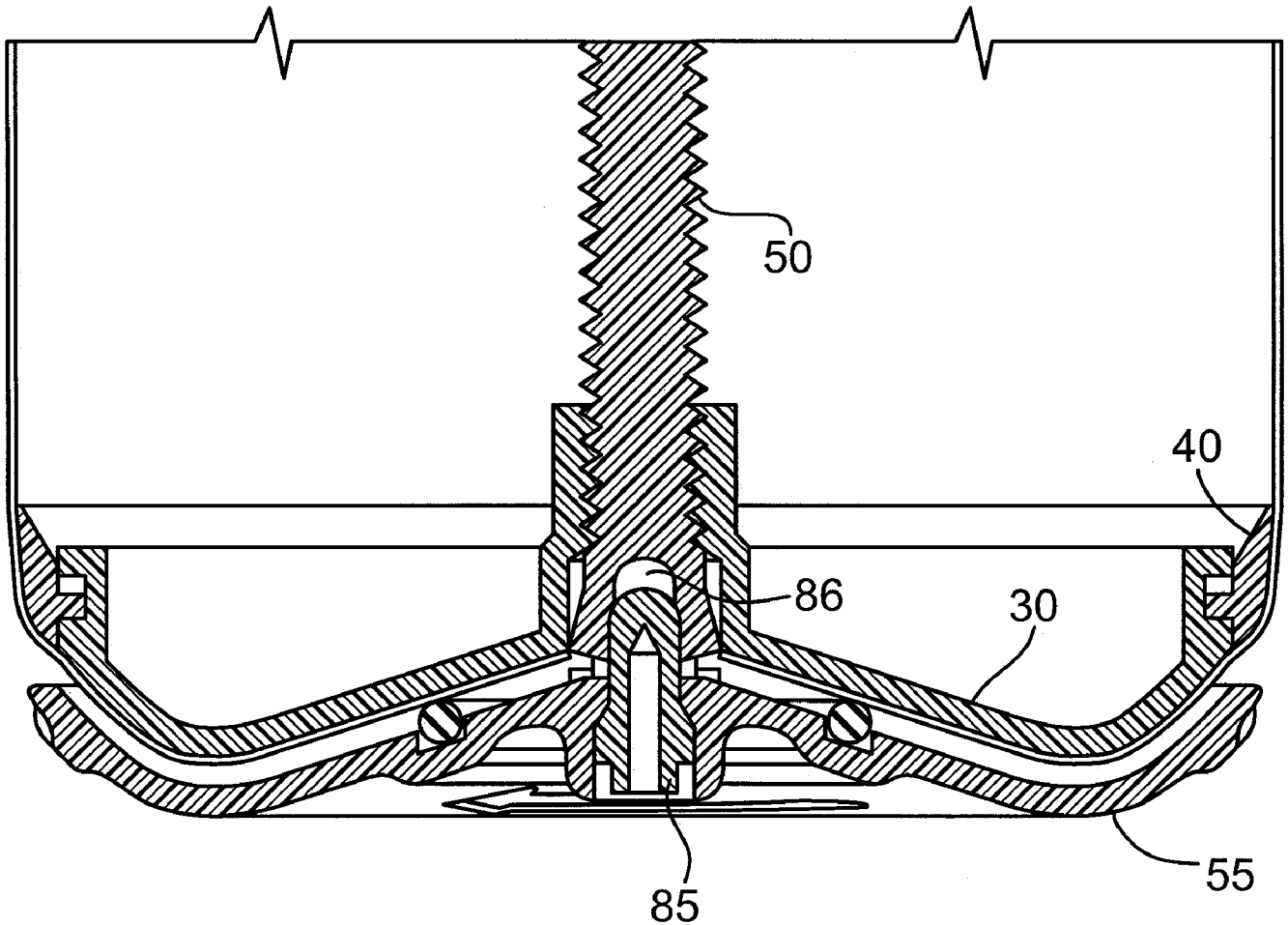

In some applications, advancement of the platform 30 within the container may create a zone of negative pressure beneath the platform 30. In certain types of containers (for example large containers) the negative pressure may be significant, leading to leakage of product from above the platform, and/or deformation of the sides of the container within this zone. Accordingly, a one-way valve may be provided at the base of the container to passively draw outside air into the space beneath the platform 30, relieving the negative pressure. With reference to FIGS. 7*a* and *b*, one-way valve 85 is inserted into the turn wheel 55, to allow air to pass from the outside, through the valve 85, and into an airspace 86. The threaded rod contains apertures such that the airspace 86 is open to the zone beneath the platform as the platform is advanced.

Use

A consumer purchasing the above assembled and filled container would simply remove product from the container in the usual manner, for example using a knife, spoon, or spatula. At any point, the user may actuate the turn wheel 55 to advance the platform 30 toward the mouth 11 of the container 10. In some instances, the user may wish to wait until the container is emptied by 90% or more, using the platform only to scrape the sides of the container. In other situations, the user may wish to advance the wheel as the container is emptied such that food product is always available within the top half of the container.

EXAMPLE

A prototype according to the following parameters was made and tested: A typical 1.5 kg plastic peanut butter container was perforated at its base and retrofitted with an emptying mechanism. The container was 6¾ inches in height and the diameter varied from bottom to top, 4 7/16 to 4 3/16, respectively. The inside diameter of the container varied from 4⅜ inches at the bottom to 4¼ inches at the top. The platform was machined from nylon stock to a diameter of 4 3/16 inches, and a silicone gasket was attached as a scraping edge, with inner diameter of 4⅛ and an outer diameter of 4 7/16 inches. The plastic turn wheel was 4 7/16 inches in diameter and was attached to a threaded rod 2⅛ inches long. As the bottom of the container was concave in shape, the threaded rod extended to a height of 5⅛ within the container.

When the above container was filled with peanut butter, the turn wheel was easily manipulated by the user to advance the platform against 100% of the container contents, pushing peanut butter through the top opening. The silicone gasket did not invert during testing and successfully scraped the sides of the container as it was advanced.

All components that may come into contact with food product should be designed and manufactured in accordance with appropriate standards and guidelines, and the containers should further be assembled in accordance with these guidelines.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A container for storing viscous food product contents, the container comprising:

a. side walls and a concave bottom defining a container interior, wherein said concave bottom comprises a central aperture and wherein said food product contents are in continuous contact with said side walls;

b. an open mouth through which the food product contents may be accessed;

c. a container lid for sealing said open mouth of the container;

d. a food product contents support base for placement within the container interior, said food product contents support base comprising:

i. a dish-shaped central platform for holding the food product contents;

ii. a detachable and replaceable outer scraping gasket disposed around said dish-shaped central platform and in scraping contact with said side walls for scraping food product contents from the side walls and into said dish-shaped central platform;

iii. a central threaded aperture for receiving a threaded rod through said bottom central aperture;

iv. a concave turn wheel fixed to said threaded rod and disposed outside of the container below and adjacent to the concave bottom in a nesting arrangement; and, v. a sealing gasket having a first seal disposed between the concave turn wheel and the concave bottom and a second seal disposed between the concave bottom and the dish-shaped central platform;

vi. so that when the concave turn wheel is rotated clockwise the threaded rod is similarly rotated thereby driving the dish-shaped central platform towards the open mouth of the container and causing the scraping gasket to scrape the walls clean of food product contents which fall onto the dish-shaped platform and further causing the food product contents to rise within the container for easier access via the mouth.

2. The container of claim 1 wherein said outer scraping gasket is a food compatible silicon gasket.

3. The container of claim 1 wherein the outer scraping gasket is a food compatible nitrile gasket.

4. The container of claim 1 wherein the outer scraping gasket includes a ring attachment portion for mating with a corresponding ledge disposed circumferentially around the dish-shaped central platform.

5. The container of claim 1 wherein the turn wheel is anchored to the dish-shaped central platform by at least two anchor clips so that the concave turn wheel retains its position adjacent to the concave bottom of the container as it is turned.

6. The container of claim 1 further comprising a one-way valve disposed between the dish-shaped central platform and the concave turn wheel so that negative pressure induced by upwards movement of the dish-shaped central platform can be relieved thereby preventing deformation of the container side walls due to internal negative pressure.

7. The container of claim 6 wherein the threaded rod comprises at least one aperture through a bottom portion thereof for pressure equalization as the dish-shaped platform is advanced towards the open mouth of the container.

8. The container of claim 1 wherein the concave turn wheel has a bottom surface that is ribbed for hand gripping and turning.

9. The container of claim 1 wherein the concave bottom comprises the concave turn wheel having a sealed rotational attachment to the side walls of the container and fixed to the treaded rod.

10. A container for storing viscous food product contents, the container comprising:

a. side walls and an integral concave bottom defining a container interior, wherein said concave bottom comprises a central aperture;

b. an open mouth through which said contents may be accessed;

c. a container lid for sealing the open mouth of the container;

d. a contents support base for placement within the container interior, said contents support base comprising:

i. a dish-shaped central platform for holding the contents;

ii. a detachable and replaceable outer scraping gasket disposed around said dish-shaped central platform and in scraping contact with said side walls for scraping contents from the side walls and into said dish-shaped central platform, wherein said scraping gasket comprises one of food compatible silicone and nitrile, and wherein the outer scraping gasket includes a ring attachment portion for mating with a corresponding ledge disposed circumferentially around the central platform;

iii. a central threaded aperture for receiving a threaded rod through said bottom central aperture;

iv. a concave turn wheel fixed to said threaded rod and disposed outside of the container below and adjacent to the concave bottom in a nesting arrangement wherein said concave turn wheel is anchored to the platform by anchor clips so that the turn wheel retains its position adjacent to the bottom of the container as it is turned and wherein the turn wheel has a bottom surface that is ribbed for hand gripping and turning;

v. a sealing gasket having a first seal disposed between the turn wheel and the bottom and a second seal disposed between the bottom and the central platform;

vi. a one-way valve disposed between the platform and the turn wheel so that negative pressure induced by upwards movement of the platform can be relieved thereby preventing deformation of the container side walls;

vii. so that when the turn wheel is rotated clock-wise the threaded rod is similarly rotated thereby driving the platform towards said mouth of the container and causing the scraping gasket to scrape the walls clean of contents which fall onto the platform and further causing contents to rise within the container for easier access by the mouth.

11. The container of claim 10 wherein the threaded rod comprises at least one aperture through a bottom portion thereof for pressure equalization as the platform is advanced towards the mouth of the container.

* * * * *